United States Patent [19]

Lafeber et al.

[11] Patent Number: 4,462,229

[45] Date of Patent: Jul. 31, 1984

[54] CLOSEABLE THREADLINE GUIDE FOR SUPPRESSING FLUID FLOW

[75] Inventors: André Lafeber, Harrogate, England; Frank R. Wilson, Abergavenny, Wales

[73] Assignee: Imperial Chemical Industries PLC, London, England

[21] Appl. No.: 437,760

[22] Filed: Oct. 29, 1982

[30] Foreign Application Priority Data

Nov. 19, 1981 [GB] United Kingdom ..... 8134918

[51] Int. Cl.[3] ..... D06B 23/00; D06B 23/18

[52] U.S. Cl. ..... 68/212; 34/242; 68/5 E; 68/6; 68/19

[58] Field of Search ..... 68/5 E, 6, 19, 212; 34/152, 154, 242; 28/272, 281, 283; 57/352, 353; 15/210 B; 251/208; 137/625.3, 625.31

[56] References Cited

U.S. PATENT DOCUMENTS

| | | | |
|---|---|---|---|
| 1,191,700 | 7/1916 | Howes | 251/208 X |
| 1,965,471 | 7/1934 | Schaaff | 57/352 X |
| 2,299,145 | 10/1942 | Hill et al. | 68/6 X |
| 2,529,563 | 11/1950 | Miller | 68/6 X |
| 2,638,330 | 5/1953 | Morgenroth | 251/208 X |
| 2,690,663 | 10/1954 | McDermott | 68/19 |
| 2,954,687 | 10/1960 | Yazawa et al. | 68/5 E |
| 3,146,794 | 9/1964 | Hollman | 137/625.31 X |
| 3,207,181 | 9/1965 | Willis | 251/208 X |
| 3,987,819 | 10/1976 | Scheuermann | 251/208 X |
| 4,074,544 | 2/1978 | Luthi | 68/5 E |
| 4,100,660 | 7/1978 | Nemecek et al. | 28/271 |
| 4,271,866 | 6/1981 | Bey | 137/625.3 |
| 4,327,758 | 5/1982 | Uhlmann | 251/208 X |

FOREIGN PATENT DOCUMENTS

| | | | |
|---|---|---|---|
| 843832 | 7/1952 | Fed. Rep. of Germany | 251/208 |
| 267245 | 3/1927 | United Kingdom | 137/625.31 |
| 905178 | 9/1962 | United Kingdom . | |
| 1505304 | 3/1978 | United Kingdom . | |

*Primary Examiner*—Philip R. Coe

*Attorney, Agent, or Firm*—Scully, Scott, Murphy & Presser

[57] ABSTRACT

A fluid flow suppressor for use with a number of running threadlines comprising a pair of plates which are rotatable about a common axis substantially parallel to the threadlines, the plates being provided with apertures through which the threadlines may be threaded when the apertures are superimposed and a number of slots corresponding to the number of threadlines, the slots in one of the plates opening into the right hand side of the aperture in that plate and the slots in the other of the plates opening into the left hand side of the aperture in that other plate, the slots being so disposed that on rotation of the plates they superimpose on each other.

6 Claims, 7 Drawing Figures

CLOSEABLE THREADLINE GUIDE FOR SUPPRESSING FLUID FLOW

This invention relates to apparatus for suppressing fluid flow along a running threadline such as a melt spun fibre. During manufacture, such running threadlines are commonly forwarded axially through fluid treatment zones such as heating zones supplied with steam at a high pressure. Apparatus according to the present invention is particularly suited to suppress fluid escape at the entrance and exit of such treatment zones and to strip entrained fluid from such running threadlines moving at a high speed.

A fluid flow suppressor according to the present invention for use with a running threadline comprises a pair of mutually moveable members provided with apertures through which the threadline may be threaded when the apertures are superimposed, characterised in that each of the members are provided with a slot, the slot in one of the members opening into the right hand side of the aperture on that member and the slot on the other of the members opening into the left hand side of the aperture on that other member, the slots being so disposed that on mutual movement of the members they superimpose across each other.

In use the members of such a fluid flow suppressor are first mutually moved to achieve substantial overlap of apertures and a threadline is threaded through them. The members are then mutually moved to achieve overlap of the slots instead of the apertures and to engage the threadline at the slot cross over point. Fluid flow axially of the threadline is then suppressed by being confined to the cross sectional area of the cross over point not occupied by the strand.

The members may have more than one slot opening into an aperture and may have more than one aperture, so as to be useable with a plurality of threadlines. A fluid flow suppressor according to the invention may also comprise a plurality of pairs of cooperating members disposed in line so that a threadline may pass through them in sequence, whereby fluid flow may be more effectively suppressed.

Either one or both of the members of a pair may be moveable, and their movement may be by translation or rotation.

Preferably the members are plates, both rotatable about a common axis substantially parallel to the threadline. In use such a pair of plates may first be rotated so that their apertures superimpose in a convenient position for threading a threadline through them; then one plate can be rotated to engage the threadline in its slot without moving it substantially from its position when threaded through the apertures; and finally the other plate can be rotated to engage the threadline in its slot where it crosses the first slot; the apertures thereby being closed off and only the slot cross over area not occupied by the threadline remaining open.

For ease of construction and to achieve good sealing against fluid flow two mutually rotatable apertures plates are conveniently held in mutual sliding contact between two fixed plates which have apertures in register. The fixed plates can be rigidly attached to a supporting structure and can for instance be closures of entrance and exit ports of a treatment device such as a tube or an oven. For threading, the apertures of all four plates are registered. Then by rotation of the rotatable plates the strand is engaged in their slots, and the apertures in the fixed plates become closed except at the cross over point of the slots of the rotatable plates.

An advantage of a device according to the present invention is that a very small cross sectional area of slot overlap, yielding good fluid flow suppression, can be achieved without need for accurate mutual registration of the members and without danger of threadline trapping. Both the shape and area and also the position of the slot overlap can be made insensitive to the positioning of each member and also to the positioning of the slot during manufacture of the member. No close manufacturing tolerances are involved. This is particularly useful in the case of flow suppressors comprising a plurality of pairs of members. Another advantage of a preferred construction of rotatable plates is cheapness and robustness using lapped plates in sliding contact to provide good sealing and even wear.

One example of a single pair of rotatable plates comprising a suppressor according to the invention for use with four parallel strands arranged substantially in one plane is illustrated in the accompanying drawings in which.

Figure 1:
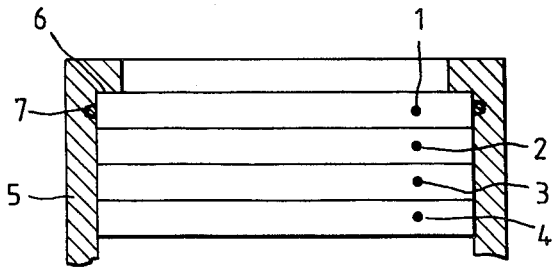
FIG. 1 is a cross section of a pack of four plates 1 to 4 in a housing.
Figure 2:
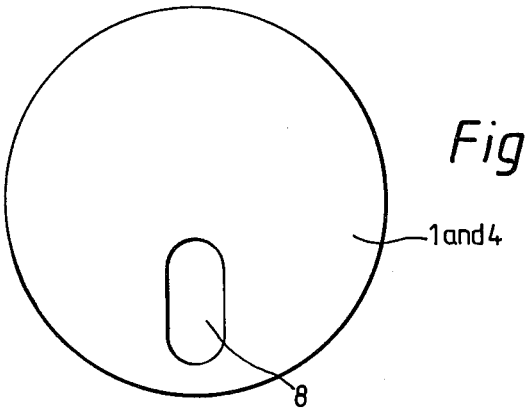
FIG. 2 is a plan view of one of fixed plates 1 and 4.
Figure 3:
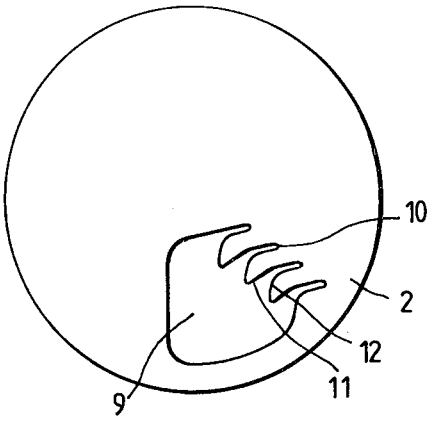
Figure 4:
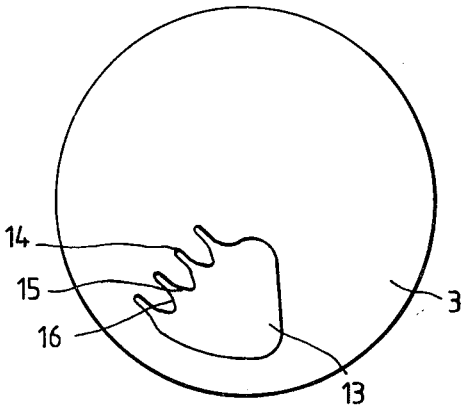

FIGS. 3 and 4 are plan views of rotatable plates 2 and 3.

Figure 5:
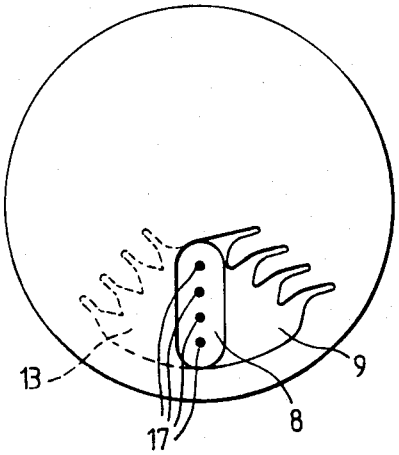
Figure 6:
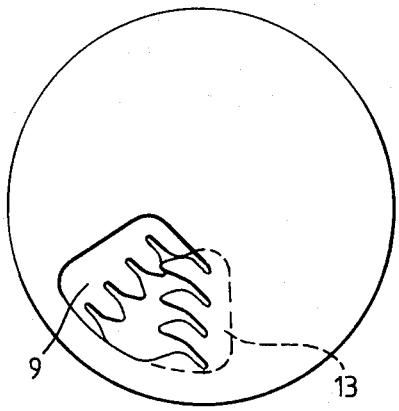
Figure 7:
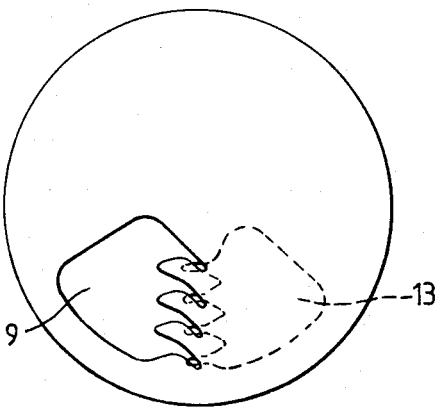

FIGS. 5, 6 and 7 are plan views of the two rotatable plates in three different relative positions.

Plate 1 is held non rotatably in a housing 5 against a retaining rim 6 and a sealing ring 7. Plates 2 and 3 are retained rotatably within housing 5 between plate 1 and another non rotatable plate 4 which is urged towards plate 3 by known means such as springs or pneumatic pressure. The mutually contacting surfaces of the plates are lapped to facilitate rotation without excessive wear or fluid leakage. Plates 1 and 4 are provided with apertures 8. Plate 2 is provided with a slotted aperture 9 having four slots 10 whose length is inclined between circumferential and radial directions and which open into the right hand side of aperture 9 via jaws 11 and 12. Plate 3 is provided with a slotted aperture 13 having four substantially circumferentially oriented slots 14 opening into the left hand side of aperture 13 via jaws 15 and 16.

In operation the plates are first moved into the relative positions illustrated in FIG. 5. Four running threadlines 17 are threaded through the superimposed apertures 8, 9 and 13 in the positions illustrated. Then plate 2 is rotated so that aperture 9 moves into the position illustrated in FIG. 6 so that the threadlines are temporarily deflected over jaw faces 12 and then return to their original positions 17 but now through slots 10. Finally plate 3 is rotated so that aperture 13 moves into the position illustrated in FIG. 7. The threadlines are thereby engaged in slots 14 as well as slots 10 and the apertures 8 in plates 1 and 4 are closed by plates 2 and 3 except for the small slot crossover areas not occupied by the threadlines.

Closures according to the invention are particularly useful at the exits and entrances of super-atmospheric steam treatment tubes used in synthetic fibre spinning processes.

We claim:

1. A fluid flow suppressor for use with a running threadline comprising a pair of members, at least one of which is movable with respect to the other, provided with apertures through which the threadline may be threaded when the apertures are superimposed, the improvement being that each of the members are provided with a slot, the slot in one of the members opening into the right hand side of the aperture in that member and the slot on the other of the members opening into the left hand side of the aperture in that other member, the slots being so disposed that on mutual movement of the members they superimpose across each other, in which position fluid flow axially of the threadline is suppressed by being confined to the cross sectional area of the superimposed slots not occupied by the running threadline.

2. A fluid flow suppressor as claimed in claim 1 in which each of the members are provided with more than one slot opening into an aperture.

3. A fluid flow suppressor as claimed in claim 1 in which both members are moveable.

4. A fluid flow suppressor for use with a running threadline comprising a pair of plates which are rotatable about a common axis substantially parallel to the threadline, the plates being provided with apertures through which the threadline may be threaded when the apertures are superimposed and with a slot, the slot in one of the plates opening into the right hand side of the aperture in that plate and the slot in the other of the plates opening into the left hand side of the aperture in that other plate, the slots being so disposed that on rotation of the plates they superimpose across each other, in which position fluid flow axially of the threadline is suppressed by being confined to the cross sectional area of the superimposed slots not occupied by the running threadline.

5. A fluid flow suppressor as claimed in claim 4 in which each of the plates are provided with more than one slot opening into an aperture.

6. A fluid flow suppressor as claimed in either claim 4 or claim 5 in which the two rotatable plates are held in mutual sliding contact between two fixed plates provided with apertures in register.

* * * * *